US007374651B2

(12) United States Patent
Aiba et al.

(10) Patent No.: US 7,374,651 B2
(45) **Date of Patent: *May 20, 2008**

(54) ELECTROLYTIC COPPER PLATING METHOD, PHOSPHORUS-CONTAINING ANODE FOR ELECTROLYTIC COPPER PLATING, AND SEMICONDUCTOR WAFER PLATED USING THEM AND HAVING FEW PARTICLES ADHERING TO IT

(75) Inventors: Akihiro Aiba, Ibaraki (JP); Takeo Okabe, Ibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 497 days.

This patent is subject to a terminal disclaimer.

(21) Appl. No.: 10/478,750

(22) PCT Filed: Nov. 28, 2002

(86) PCT No.: PCT/JP02/12437

§ 371 (c)(1),
(2), (4) Date: Nov. 24, 2003

(87) PCT Pub. No.: WO03/078698

PCT Pub. Date: Sep. 25, 2003

(65) Prior Publication Data

US 2004/0149588 A1 Aug. 5, 2004

(30) Foreign Application Priority Data

Mar. 18, 2002 (JP) ..... 2002-074659

(51) Int. Cl.
*C25D 5/00* (2006.01)
*C22C 9/00* (2006.01)

(52) U.S. Cl. ..... 205/80; 420/469; 420/499

(58) Field of Classification Search ..... 205/80; 420/469, 499
See application file for complete search history.

(56) References Cited

U.S. PATENT DOCUMENTS 2,923,671 A * 2/1960 van Tilburg ..... 205/292

(Continued)

FOREIGN PATENT DOCUMENTS

JP 2000-119900 4/2000

OTHER PUBLICATIONS

Rashkov et al., "The Kinetics and Mechanism of the Anodic Dissolution of Phosphorus-Containing Copper in Bright Copper Plating Electrolytes," Surface Technology, vol. 14, No. 4, pp. 309-321, Dec. 1981.*

(Continued)

*Primary Examiner*—Susy Tsang-Foster
*Assistant Examiner*—Nicholas A. Smith
(74) *Attorney, Agent, or Firm*—Howson & Howson LLP

(57) ABSTRACT

The present invention pertains to an electrolytic copper plating method characterized in employing a phosphorous copper anode having a crystal grain size of 1500 μm (or more) to 20000 μm in an electrolytic copper plating method employing a phosphorous copper anode. Upon performing electrolytic copper plating, an object is to provide an electrolytic copper plating method of a semiconductor wafer for preventing the adhesion of particles, which arise at the anode side in the plating bath, to the plating object such as a semiconductor wafer, a phosphorous copper anode for electrolytic copper plating, and a semiconductor wafer having low particle adhesion plated with such method and anode.

8 Claims, 1 Drawing Sheet

U.S. PATENT DOCUMENTS

| | | | | |
|---|---|---|---|---|
| 6,113,771 | A * | 9/2000 | Landau et al. | 205/123 |
| 6,531,039 | B2 | 3/2003 | Kohut | 204/292 |
| 6,562,222 | B1 | 5/2003 | Sekiguchi et al. | 205/296 |
| 6,821,407 | B1 * | 11/2004 | Reid et al. | 205/292 |
| 6,830,673 | B2 * | 12/2004 | Yahalom et al. | 205/83 |
| 2002/0000371 | A1 | 1/2002 | Mishima et al. | 204/199 |
| 2003/0188975 | A1 * | 10/2003 | Nielsen | 205/292 |
| 2004/0007474 | A1 | 1/2004 | Okabe et al. | 205/292 |
| 2004/0200727 | A1 | 10/2004 | Aiba et al. | 205/157 |

OTHER PUBLICATIONS

Walker, "The Anatomy of a Copper Anode," Plating and Surface Finishing, vol. 77, No. 10, pp. 16-17, Oct. 1990.*

Volotovskaya et al., "Improved copper anodes with phosphorus for bright copper electroplating," Avtomobil'naya Promyshlennost, 44(11), pp. 33-34 (Russian) 1978.*

Kalev et al., "Production of Phosphorus-Containing Copper Anodes by Counter-Pressure Casting", Tekhnicheska Misul (1982) vol. 19, No. 1, pp. 101-107.

Patent Abstracts of Japan, one page English Abstract of JP 2000-119900, Apr. 2000.

* cited by examiner

ELECTROLYTIC COPPER PLATING METHOD, PHOSPHORUS-CONTAINING ANODE FOR ELECTROLYTIC COPPER PLATING, AND SEMICONDUCTOR WAFER PLATED USING THEM AND HAVING FEW PARTICLES ADHERING TO IT

FIELD OF THE INVENTION

The present invention pertains to an electrolytic copper plating method capable of preventing the adhesion of particles to a plating object, a semiconductor wafer in particular, a phosphorous copper anode for such electrolytic copper plating, and a semiconductor wafer having low particle adhesion and electrolytic copper plated with the foregoing method and anode.

BACKGROUND OF THE INVENTION

Generally, although an electrolytic copper plate has been employed for forming copper wiring in a PWB (print wiring board) or the like, in recent years, it is being used for forming copper wiring of semiconductors. An electrolytic copper plate has a long history, and it has reached its present form upon accumulating numerous technical advancements. Nevertheless, when employing this electrolytic copper plate for forming copper wiring of semiconductors, a new problem arose which was not found in a PWB.

Ordinarily, when performing electrolytic copper plating, phosphorous copper is used as the anode. This is because when an insoluble anode formed from the likes of platinum, titanium, or iridium oxide is used, the additive within the plating liquid would decompose upon being affected by anodic oxidization, and inferior plating will occur thereby. Moreover, when employing electrolytic copper or oxygen-free copper of a soluble anode, a large amount of particles such as sludge is generated from metallic copper or copper oxide caused by the disproportionation reaction of monovalent copper during dissolution, and the plating object will become contaminated as a result thereof.

On the other hand, when employing a phosphorous copper anode, a black film composed of phosphorous copper or copper chloride is formed on the anode surface due to electrolysis, and it is thereby possible to suppress the generation of metallic copper or copper oxide caused by the disproportionation reaction of monovalent copper, and to control the generation of particles.

Nevertheless, even upon employing phosphorous copper as the anode as described above, it is not possible to completely control the generation of particles since metallic copper or copper oxide is produced where the black film drops off or at portions where the black film is thin.

In light of the above, a filter cloth referred to as an anode bag is ordinarily used to wrap the anode so as to prevent particles from reaching the plating liquid.

Nevertheless, when this kind of method is employed, particularly in the plating of a semiconductor wafer, there is a problem in that minute particles, which were not a problem in forming the wiring of a PWB and the like, reach the semiconductor wafer, such particles adhere to the semiconductor, and thereby cause inferior plating.

OBJECTS OF THE INVENTION

An object of the present invention is to provide an electrolytic copper plating method capable of preventing the adhesion of particles to a plating object, a semiconductor wafer in particular, a phosphorous copper anode for such electrolytic copper plating, and a semiconductor wafer having low particle adhesion and plated with the foregoing method and anode.

SUMMARY OF THE INVENTION

In order to achieve the foregoing object, as a result of intense study, the present inventors discovered that it is possible to stably perform electrolytic copper plating to the likes of a semiconductor wafer having low particle adhesion by improving the electrode materials.

Based on the foregoing discovery, the present invention provides:

1. An electrolytic copper plating method employing a phosphorous copper anode, wherein employed is a phosphorous copper anode having a crystal grain size of 1500 μm (or more) to 20000 μm;
2. An electrolytic copper plating method according to paragraph 1 above, wherein the phosphorous content of the phosphorous copper anode is 50 to 2000 wt ppm; and
3. An electrolytic copper plating method according to paragraph 1 above, wherein the phosphorous content of the phosphorous copper anode is 100 to 1000 wt ppm.

The present invention further provides:

4. A phosphorous copper anode for performing electrolytic copper plating, wherein the crystal grain size of the phosphorous copper anode is 1500 μm (or more) to 20000 μm;
5. A phosphorous copper anode for electrolytic copper plating according to paragraph 4 above, wherein the phosphorous content of the phosphorous copper anode is 50 to 2000 wt ppm;
6. A phosphorous copper anode for electrolytic copper plating according to paragraph 4 above, wherein the phosphorous content of the phosphorous copper anode is 100 to 1000 wt ppm;
7. An electrolytic copper plating method and a phosphorous copper anode for electrolytic copper plating according to each of paragraphs 1 to 6 above, wherein the electrolytic copper plating is performed to a semiconductor wafer; and
8. A semiconductor wafer having low particle adhesion plated with the electrolytic copper plating method and phosphorous copper anode for electrolytic copper plating according to each of paragraphs 1 to 7 above.

DETAILED DESCRIPTION OF THE PREFERRED EMBODIMENT

Figure 1:
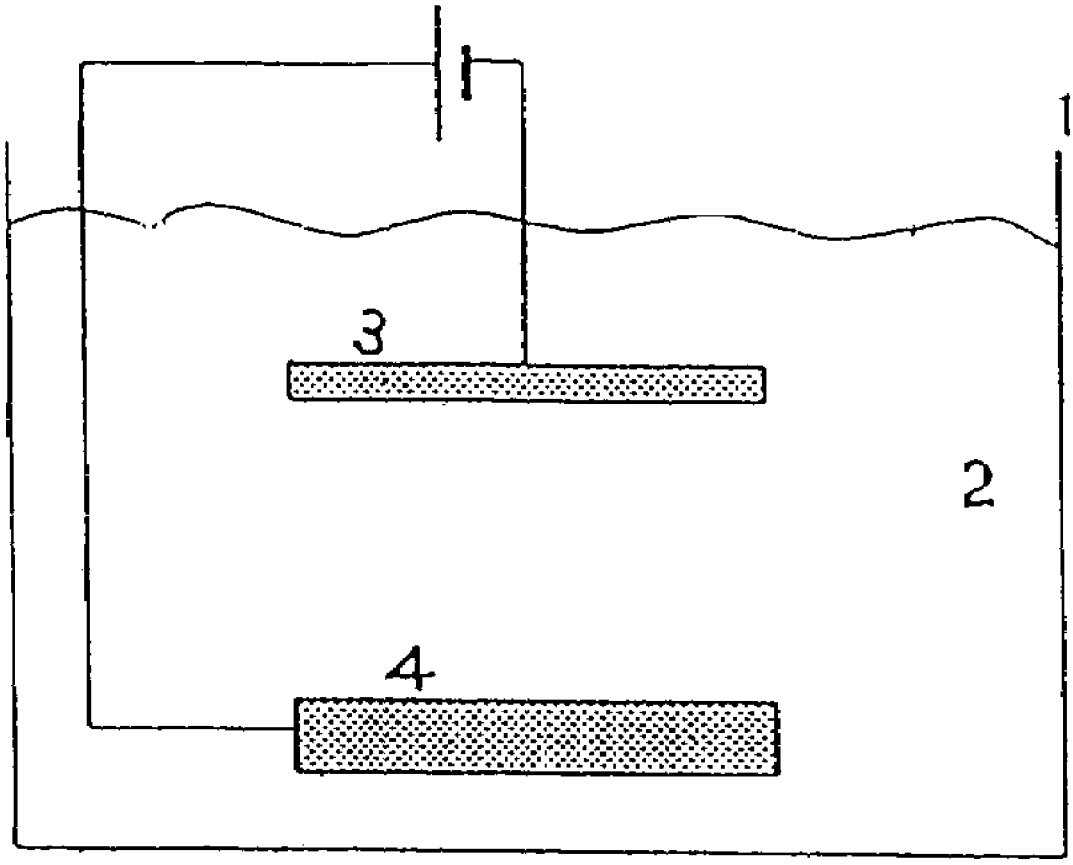
FIG. 1 is a conceptual diagram of a device used in the electrolytic copper plating method of a semiconductor wafer according to the present invention.

FIG. 1 is a diagram illustrating an example of the device employed in the electrolytic copper plating method of a semiconductor wafer. This copper plating device comprises a tank 1 having copper sulfate plating liquid 2. An anode 4 composed of a phosphorous copper anode as the anode is used, and, as the cathode, for example, a semiconductor wafer is used as the object of plating.

As described above, when employing phosphorous copper as the anode upon performing electrolytic plating, a black film composed of phosphorous copper or copper chloride is formed on the surface, and this yields the function of suppressing the generation of particles such as sludge composed of metallic copper or copper oxide caused by the disproportionation reaction of monovalent copper during the dissolution of the anode.

Nevertheless, the generation speed of the black film is strongly influenced by the current density of the anode, crystal grain size, phosphorous content, and so on, and, higher the current density, smaller the crystal grain size, and higher the phosphorous content, the foregoing generation speed becomes faster, and, as a result, it has become evident that the black film tends to become thicker as a result thereof.

Contrarily, lower the current density, larger the crystal grain size, and lower the phosphorous content, the foregoing generation speed becomes slower, and, as a result, the black film becomes thinner.

As described above, although a black film yields the function of suppressing the generation of particles such as metallic copper or copper oxide, when the black film is too thick, the film will separate and drop off, and there is a major problem in that such separation in itself will cause the generation of particles. Contrarily, when the black film is too thin, there is a problem in that the effect of suppressing the generation of metallic copper or copper oxide will deteriorate.

Therefore, in order to suppress the generation of particles from the anode, it is extremely important to optimize the current density, crystal grain size, and phosphorous content, respectively, and to form a stable black film with an appropriate thickness.

In light of the above, the present inventors previously proposed an electrolytic copper plating method employing a phosphorous copper anode in which the crystal grain size was adjusted to be 10 to 1500 μm (Japanese Patent Application No. 2001-323265).

This method is effective for suppressing the generation of sludge arising at the anode side in the plating bath. Here, subject to the maximum crystal grain size of the anode being 1500 μm, this was based on the premise that, in the case of a phosphorous copper anode having a crystal grain size exceeding such value, the sludge tended to increase.

Nevertheless, upon having sufficiently observed the condition of particle adhesion to the plating object such as a semiconductor wafer, even when the crystal grain size of the anode exceeded the limit of 1500 μm, regardless of the sludge increasing to a certain degree at the anode side in the plating bath, it has become known that the adhesion of particles to the plating object does not necessarily increase.

In view of the above, the present invention proposes a phosphorous copper anode indicating an optimum value. The phosphorous copper anode of the present invention employs a phosphorous copper anode having a crystal grain size of 1500 μm (or more) to 20000 μm.

When the crystal grain size exceeds 20000 μm, since it has been confirmed that the adhesion of particles on the plating object tends to increase, the upper limit value has been set to 20000 μm.

Moreover, the phosphorous content of the phosphorous copper anode is 50 to 2000 wt ppm, and preferably 100 to 1000 wt ppm.

By performing electrolytic copper plating with the phosphorous copper anode of the present invention, it is possible to prevent particles from reaching the semiconductor wafer, adhering to such semiconductor wafer and causing inferior plating.

As described above, regardless of the amount of sludge arising at the rough particle diameter side (1500 μm (or more) to 20000 μm) being large, the number of particles adhering to the semiconductor wafer decreased. The reason for this is considered to be because the sludge component changes at the minute particle diameter side and the rough particle diameter side, and being affected thereby.

In other words, the sludge arising at the minute particle diameter side is often copper chloride and copper phosphide, which are the main components of a black film, and the principle component of the sludge arising at the rough particle diameter side changes to metallic copper.

Although copper chloride and copper phosphide float easily in the bath since the relative density thereof is light, as the relative density of metallic copper is heavy, it does not float in the bath often. Thus, it is considered that a reverse phenomenon occurs in which, regardless of the amount of sludge arising at the rough particle diameter side being large, the particles adhering to the semiconductor wafer decreases.

As described above, it has become known that the electrolytic copper plating employing a phosphorous copper anode having a rough particle diameter (1500 μm (or more) to 20000 μm) of the present invention is extremely effective in plating semiconductor wafers in particular.

The electrolytic copper plating employing such phosphorous copper anode is also effective as a method for reducing the defective fraction of plating caused by particles even in the copper plating of other fields in which thinning is advancing.

As described above, the phosphorous copper anode of the present invention yields an effect of significantly reducing contamination on the plating object caused by the adhesion of particles, and another effect is yielded in that the decomposition of additives in the plating bath and the inferior plating resulting thereby, which conventionally occurred when an insoluble anode was used, will not occur.

As the plating liquid, an appropriate amount of copper sulfate: 10 to 70 g/L (Cu), sulfuric acid: 10 to 300 g/L, chlorine ion 20 to 100 mg/L, additive: (CC-1220: 1 mL/L or the like manufactured by Nikko Metal Plating) may be used. Moreover, it is desirable that the purity of the copper sulfate be 99.9% or higher.

In addition, it is desirable that the plating temperature is 15 to 35° C., cathode current density is 0.5 to 10 A/dm$^2$, and anode current density is 0.5 to 10 A/dm$^2$. Although preferable examples of plating conditions are described above, it is not necessarily required to limit the conditions to the foregoing examples.

EXAMPLES AND COMPARATIVE EXAMPLES

Next, the Examples of the present invention are explained. Further, these Examples are merely illustrative, and the present invention shall in no way be limited thereby. In other words, the present invention shall include all other modes or modifications other than these Examples within the scope of the technical spirit of this invention.

Examples 1 to 3

As shown in Table 1, phosphorous copper having a phosphorous content of 500 wt ppm was used as the anode, and a semiconductor wafer was used as the cathode. The crystal grain size of these phosphorous copper anodes was 1800 μm, 5000 μm and 18000 μm.

As the plating liquid, copper sulfate: 20 g/L (Cu), sulfuric acid: 200 g/L, chlorine ion 60 mg/L, additive [brightening agent, surface active agent] (Product Name CC-1220: manufactured by Nikko Metal Plating): 1 mL/L were used. The purity of the copper sulfate in the plating liquid was 99.99%.

The plating conditions were plating temperature 30° C., cathode current density 3.0 A/dm$^2$, anode current density 3.0 A/dm$^2$, and plating time 120 hr.

The foregoing conditions are shown in Table 1.

After the plating, the generation of particles and plate appearance were observed. The results are similarly shown in Table 1. Regarding the number of particles, after having performed electrolysis under the foregoing electrolytic conditions, the semiconductor wafer was replaced, plating was performed for 1 min., and particles of 0.2 μm or more that adhered to the semiconductor wafer (8 inch) were measured with a particle counter.

Regarding the plate appearance, after having performed electrolysis under the foregoing electrolytic conditions, the semiconductor wafer was replaced, plating was conducted for 1 min., and the existence of burns, clouding, swelling, abnormal deposition, foreign material adhesion and so on were observed visually. Regarding embeddability, the embeddability of semiconductor wafer via having an aspect ratio of 5 (via diameter 0.2 μm) was observed in its cross section with an electronic microscope.

As a result of the above, the number of particles in Examples 1 to 3 was 3, 4 and 7, respectively, which is extremely few, and the plate appearance and embeddability were also favorable.

Comparative Examples 1 to 3

As shown in Table 2, phosphorous copper having a phosphorous content of 5 wt ppm was used as the anode, and a semiconductor wafer was used as the cathode. The crystal grain size of these phosphorous copper anodes was 3 μm, 800 μm and 30000 μm.

As the plating liquid, similar to Examples 1 to 3, copper sulfate: 20 g/L (Cu), sulfuric acid: 200 g/L, chlorine ion 60 mg/L, additive [brightening agent, surface active agent] (Product Name CC-1220: manufactured by Nikko Metal Plating): 1 mL/L were used. The purity of the copper sulfate within the plating liquid was 99.99%.

The plating conditions, similar to Examples 1 to 3, were plating temperature 30° C., cathode current density 3.0 A/dm$^2$, anode current density 3.0 A/dm$^2$, and plating time 120 hr. The foregoing conditions are shown in Table 2.

After the plating, the generation of particles and plate appearance were observed. The results are shown in Table 2. The number of particles, plate appearance and embeddability were also evaluated as with Examples 1 to 3.

As a result of the above, although the plate appearance and embeddability were favorable in Comparative Examples 1 to 3, the number of particles was 256, 29 and 97, respectively, which showed significant adhesion to the semiconductor wafer, and the results were inferior.

| | | Examples | | |
|---|---|---|---|---|
| | | 1 | 2 | 3 |
| Anode | Crystal Grain Diameter (μm) | 1800 | 5000 | 18000 |
| | Phosphorus Content (ppm) | 500 | 500 | 500 |
| Plating Liquid | Metallic Salt | Copper Sulfate: 20 g/L(Cu) | Copper Sulfate: 20 g/L(Cu) | Copper Sulfate: 20 g/L(Cu) |
| | Acid | Sulfuric Acid: 200 g/L | Sulfuric Acid: 200 g/L | Sulfuric Acid: 200 g/L |
| | Chlorine Ion (ppm) | 60 | 60 | 60 |
| | Additive | CC-1220: 1 mL/L (Nikko Metal Plating) | CC-1220: 1 mL/L (Nikko Metal Plating) | CC-1220: 1 mL/L (Nikko Metal Plating) |
| Electrolytic Conditions | Bath Temperature (° C.) | 30 | 30 | 30 |
| | Cathode | Semiconductor Wafer | Semiconductor Wafer | Semiconductor Wafer |
| | Cathode Current Density (A/dm$^2$) | 3.0 | 3.0 | 3.0 |
| | Anode Current Density (A/dm$^2$) | 3.0 | 3.0 | 3.0 |
| | Time (h) | 120 | 120 | 120 |
| Evaluation Results | Number of Particles | 3 | 4 | 7 |
| | Plate Appearance | Favorable | Favorable | Favorable |
| | Embeddability | Favorable | Favorable | Favorable |

Regarding the number of particles, after having performed electrolysis under the foregoing electrolytic conditions, the semiconductor wafer was replaced, plating was performed for 1 min., and particles of 0.2 μm or more that adhered to the semiconductor wafer (8 inches) were measured with a particle counter.

Regarding the plate appearance, after having performed electrolysis under the foregoing electrolytic conditions, the semiconductor wafer was replaced, plating was performed for 1 min., and the existence of burns, clouding, swelling, abnormal deposition and the like was observed.

Regarding embeddability, the embeddability of semiconductor wafer via having an aspect ratio of 5 (via diameter 0.2 μm) was observed in its cross section with an electronic microscope.

| | | Comparative Examples | | |
|---|---|---|---|---|
| | | 1 | 2 | 3 |
| Anode | Crystal Grain Diameter (μm) | 3 | 800 | 30000 |
| | Phosphorus Content (ppm) | 500 | 500 | 500 |
| Plating Liquid | Metallic Salt | Copper Sulfate: 20 g/L(Cu) | Copper Sulfate: 20 g/L(Cu) | Copper Sulfate: 20 g/L(Cu) |
| | Acid | Sulfuric Acid: 200 g/L | Sulfuric Acid: 200 g/L | Sulfuric Acid: 200 g/L |
| | Chlorine Ion (ppm) | 60 | 60 | 60 |
| | Additive | CC-1220: 1 mL/L (Nikko Metal Plating) | CC-1220: 1 mL/L (Nikko Metal Plating) | CC-1220: 1 mL/L (Nikko Metal Plating) |
| Electrolytic Conditions | Bath Temperature (° C.) | 30 | 30 | 30 |
| | Cathode | Semiconductor Wafer | Semiconductor Wafer | Semiconductor Wafer |
| | Cathode Current Density ($A/dm^2$) | 3.0 | 3.0 | 3.0 |
| | Anode Current Density ($A/dm^2$) | 3.0 | 3.0 | 3.0 |
| | Time (h) | 120 | 120 | 120 |
| Evaluation Results | Number of Particles | 256 | 29 | 97 |
| | Plate Appearance | Favorable | Favorable | Favorable |
| | Embeddability | Favorable | Favorable | Favorable |

Regarding the number of particles, after having performed electrolysis under the foregoing electrolytic conditions, the semiconductor wafer was replaced, plating was performed for 1 min., and particles of 0.2 μm or more that adhered to the semiconductor wafer (8 inches) were measured with a particle counter.
Regarding the plate appearance, after having performed electrolysis under the foregoing electrolytic conditions, the semiconductor wafer was replaced, plating was performed for 1 min., and the existence of burns, clouding, swelling, abnormal deposition and the like was observed.
Regarding embeddability, the embeddability of semiconductor wafer via having an aspect ratio of 5 (via diameter 0.2 μm) was observed in its cross section with an electronic microscope.

The present invention yields a superior effect in that, upon performing electrolytic copper plating, it is capable of stably performing such electrolytic copper plating to the likes of a semiconductor wafer having low particle adhesion. The electrolytic copper plating of the present invention employing the foregoing phosphorous copper anode is also effective as a method for reducing the defective fraction of plating caused by particles even in the copper plating of other fields in which thinning is advancing.

Further, the phosphorous copper anode of the present invention yields an effect of significantly reducing the adhesion of particles and contamination on the plating object, and another effect is yielded in that decomposition of additives in the plating bath and the inferior plating resulting thereby, which conventionally occurred when an insoluble anode was used, will not occur.

The invention claimed is:

1. A method of electrolytic copper plating a semiconductor wafer, comprising the steps of:

placing the semiconductor wafer within a plating bath containing a copper sulfate plating liquid;

electrolytic copper plating the semiconductor wafer in the plating bath employing a phosphorous copper anode having a crystal grain size of 1,500 μm to 20,000 μm; and during said plating step, producing sludge from said anode having as a principle component metallic copper of a relative density such that it does not float within the plating bath thereby preventing particles from reaching the semiconductor wafer, adhering to the semiconductor wafer, and causing inferior plating.

2. A method according to claim 1, wherein said plating step includes forming copper wiring on the semiconductor wafer.

3. A method according to claim 1, further comprising the step of adjusting or optimizing the crystal grain size of the phosphorous copper anode to 1,500 μm to 20,000 μm before said plating step.

4. A method according to claim 1, wherein phosphorous content of the phosphorous copper anode is 50 to 2,000 wtppm.

5. A method according to claim 1, wherein phosphorous content of the phosphorous copper anode is 100 to 1,000 wtppm.

6. A method according to claim 1, wherein said crystal grain size of said phosphorous copper anode is 1,500 μm to 5,000 μm during said plating.

7. A method according to claim 1, wherein said crystal grain size of said phosphorous copper anode is 1,800 μm to 5,000 μm during said plating.

8. A method according to claim 1, wherein said crystal grain size of said phosphorous copper anode is 18,000 μm to 20,000 μm during said plating.

* * * * *